US008415893B2

(12) United States Patent
Kurokawa

(10) Patent No.: US 8,415,893 B2
(45) Date of Patent: Apr. 9, 2013

(54) LOAD CONTROL DEVICE, AND LIGHTING DEVICE

(75) Inventor: Fujio Kurokawa, Nagasaki (JP)

(73) Assignee: Nagasaki University, Nagasaki (JP)

( * ) Notice: Subject to any disclaimer, the term of this patent is extended or adjusted under 35 U.S.C. 154(b) by 0 days.

(21) Appl. No.: 12/739,716

(22) PCT Filed: Oct. 17, 2008

(86) PCT No.: PCT/JP2008/068842

§ 371 (c)(1),
(2), (4) Date: Jul. 2, 2010

(87) PCT Pub. No.: WO2009/054319

PCT Pub. Date: Apr. 30, 2009

(65) Prior Publication Data

US 2010/0264839 A1 Oct. 21, 2010

(30) Foreign Application Priority Data

Oct. 24, 2007 (JP) ..... 2007-275952

(51) Int. Cl.
*H05B 37/02* (2006.01)

(52) U.S. Cl. ..... 315/224; 315/225; 315/226; 315/291; 315/360; 327/45

(58) Field of Classification Search ..... 315/209 R, 315/224, 225, 226, 291, 360, DIG. 5, DIG. 7; 327/45

See application file for complete search history.

(56) References Cited

U.S. PATENT DOCUMENTS 6,963,178 B1 * 11/2005 Lev et al. ..... 315/307
7,301,376 B2 * 11/2007 Capodivacca et al. ..... 327/112

FOREIGN PATENT DOCUMENTS

| | | | |
|---|---|---|---|
| JP | 06-343270 | A | 12/1994 |
| JP | 09-130972 | A | 5/1997 |
| JP | 10-041079 | A | 2/1998 |
| JP | 2003-0530812 | A | 10/2003 |
| JP | 2006-049084 | A | 2/2006 |
| WO | 01/78467 | A1 | 10/2001 |

* cited by examiner

*Primary Examiner* — Thuy Vinh Tran
(74) *Attorney, Agent, or Firm* — Kile Park Reed & Houtteman PLLC

(57) ABSTRACT

Provided is a discharge lamp lighting device, which can control a load precisely while improving the practicability. When the difference of a count number (Nn) becomes a predetermined threshold value or less, a predictor circuit (35) predicts the timing, at which a current value (iQ1) becomes a peak value, on the basis of the rate of change of the difference. A switch selecting circuit (38), which is driven with a clock frequency higher than the sampling frequency of a first converter unit (32), turns off a field effect transistor (Q1) at the turn-off timing, and turns on a field effect transistor (Q2). A plurality of A/D converters (37*a*) are subjected to a multi-rate control, thereby to correct the threshold value of the predictor circuit (35) on the basis of the peak value of a lamp current (iOUT). Even if the peak values of current values (iQ1 and iQ2) are positioned for the sampling period of the first converter unit (32), the turn-off timings can be precisely set according to the current values (iQ1 and iQ2) without increasing the sampling frequency more than the necessary value. As a result, it is possible to improve the practicability and to control the lighting of a fluorescent lamp precisely.

6 Claims, 7 Drawing Sheets

LOAD CONTROL DEVICE, AND LIGHTING DEVICE

FIELD OF INVENTION

The present invention relates to a load control device and lighting device in an inverter circuit equipped with a switching element to drive the load. The present invention may be used for home lighting systems and the like.

BACKGROUND

Conventionally, a lighting device is known as this type of load control device. The lighting device comprises of a power inverter part to convert DC power AC power, discharging lamps driven by the power inverter part, a detection part to detect current value and voltage value of the discharge lamps, an A/D converter to convert analog current value and analog voltage value of discharge lamp into digital values respectively, an operation part to calculate a reference value standard value for control of the power inverter part according to a digital amount detected by A/D converter and a control part to control the inverter part based on the reference value (for example, refer to patent document 1: JP 1998-41079, pages 3 to 4, FIG. 1).

SUMMARY OF INVENTION

However, 8-bit A/D converter has 1 MHz to 2 MHz of sampling frequency, therefore, a resolution of the converter is from 0.5 μs to 1.0 μs, so it is impossible to execute sampling of current value or voltage value of a switching device sufficiently in the above-mentioned discharging lamps.

Accordingly, the power inverter part is controlled based on average value of samplings, but it is difficult to accurately control the power inverter part by the above control.

On the other hand, it is conceivable that resolution may be improved by using A/D converter which increased sampling frequency enough than a switching cycle. Also, it is conceivable that multi-rate control may be executed by using a plurality of A/D converters. However, in these cases, consumption current increases or a price of the equipment becomes expensive.

An object of the invention aims to provide load control device that can improve practicality and accuracy in addition to lighting device.

For the power inverter circuit, a half-bridge type circuit or a full-bridge type circuit is used.

As for the first conversion device, a voltage control oscillator with 50 MHz of oscillation frequency or 8-bit flash type A/D converter is used.

As a prediction device, DSP (Digital Signal Processor) is used.

As a control device, DSP is used. The control device is provided integrally with the prediction device or separately with the prediction device.

As for the second conversion, multiple A/D converters or a voltage control oscillator is used. These can be controlled at a multi-rate and convert an analog electric quantity output from load into digital quantity at high sampling frequency than each sampling frequency.

As for the calibration, DSP is used. Also, the control device can be provided integrally with the predictor and it can be provided with being divided with a predictor.

And predicting device predicts a time when a value of current passing through the switching element changes to a peak based on a change ratio of a difference, under status that the said difference between a digital amount that was converted by a first conversion device at one timing and a digital amount at the next timing is less than threshold value.

A control device turns off a switch under "ON state" and turns on under "OFF state" at timing predicted by the predicted device wherein the control device is driven at higher clock frequency than sampling frequency of the first conversion device.

A second conversion device converts the electric amount output from load into digital amount. A correction device corrects a value of timing predicted by predicting device based on detected value.

Even if a peak of the current value which flowed through the switching element during the sampling period of the first conversion device occurred, a sampling frequency of the first conversion device does not increase more than required. Wherein the timing of turn-off is set depending on a current value of switching element/elements precisely. Utility improves and can thereby control a load precisely.

In one embodiment, the predictive device predicts a timing that a value of current flowing through the switching element becomes the peak, based on the absolutely needed quantity of a digital amount converted by a first converter.

And based on a absolute quantity of a digital amount converted by a first converter, the predictive device predicts the timing that current value flowing through the switching element becomes a peak.

By this predicted timing, control device turns off with switching element/elements of the ON state. And control device turns on with the switching element/elements of the off state.

That is, based on a change ratio of the difference of the digital amount of current value flowing through the switching element and absolute of digital amount, the switching element can be turned-off corresponding to a peak of a current value of the switching element. More accurate load control can be thereby performed.

In some embodiments, when the change ratio of the difference increases, the control device turns off switching element/elements. And in a case that a change of the difference in the predictive device increase, control device turns off a switching element. Thus, excess current due to the circuitry abnormality is prevented.

In some embodiments, a main body of appliance which a discharge lamp as a load turned on by this load control device is attached.

And each function works by equipping with load control device described in any of the embodiments described herein.

In one embodiment of the invention, a load control device is provided. The load control device includes an inverter circuit equipped with switching elements for driving a load. The device further includes a first conversion device which converts analog current value passing through the on-state switching element into digital amount corresponding to a current sampling frequency. The load control device further includes a predicting device which predicts timing that a value of current passing through the switching element reaches a peak, under a difference between the digital amount converted according to a prescribed timing by the first conversion device and a digital amount of a timing is below a prescribed threshold. The load control device further includes a switch selection circuit which turns off the switching elements at the predicted timing by the prediction device driven with a frequency higher than the sampling frequency for the first conversion device, and turns on the switching element which was under off-state. Additionally, the load control device includes a second conversion device which converts an amount of electricity from the load into a digital amount. Finally, the load device additionally includes a correction device which detects a peak value of electricity coming from the load by a digital amount converted by the second conversion device and based on this detected peak value, corrects prediction of timing.

In some embodiments, the prediction device predicts the timing when a current value passing through the switching elements reaches its peak, based on an absolute amount of digital converted by the first conversion device. In addition, the switch selection circuit turns off the switching element under on-state at the predicted timing, and turns on the switching element under off-state.

In some embodiments, the switch selection circuit turns off the switching element when the predicting device senses an increase of the difference of the digital amounts.

In another aspect of the invention, a lighting device including the load control device described in any of the embodiments above is provided. The lighting device may additionally include a mechanical body which is equipped with a load, which is a discharge lamp which is turned on by the load control device.

DETAILED DESCRIPTION

Figure 1:
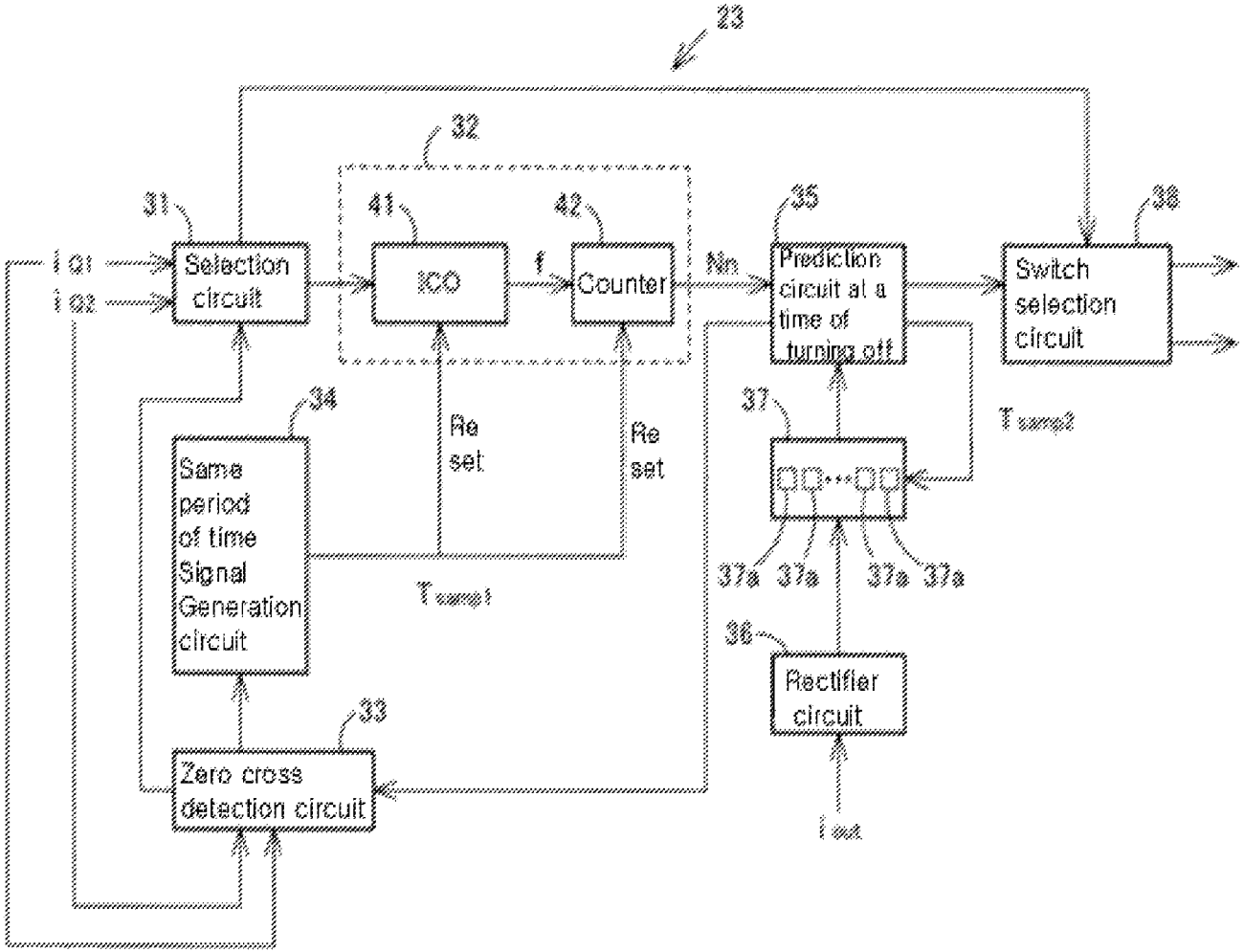
FIG. 1 illustrates a block diagram for some of a load control device indicating characteristic in accordance with one embodiment of the invention.

In the Figures, the following reference characters are defined as:

11 the lighting device
12 the main body of the lighting device
16 the discharge lamp lighting device as the load control device
22 the power inverter circuit
32 the first conversion part as the first conversion device
35 the turn-off prediction circuit with the prediction device and the calibration device
37*a* the A/D converter as the means of the second conversion device
38 the switch selection circuit as the control device
FL the flourescence lamp, a discharge lamp as the load
Q1 and Q2 the field effect transistor as the switching devices Below, mode for carrying out this invention will be explained by referring to the figures.

Figure 2:
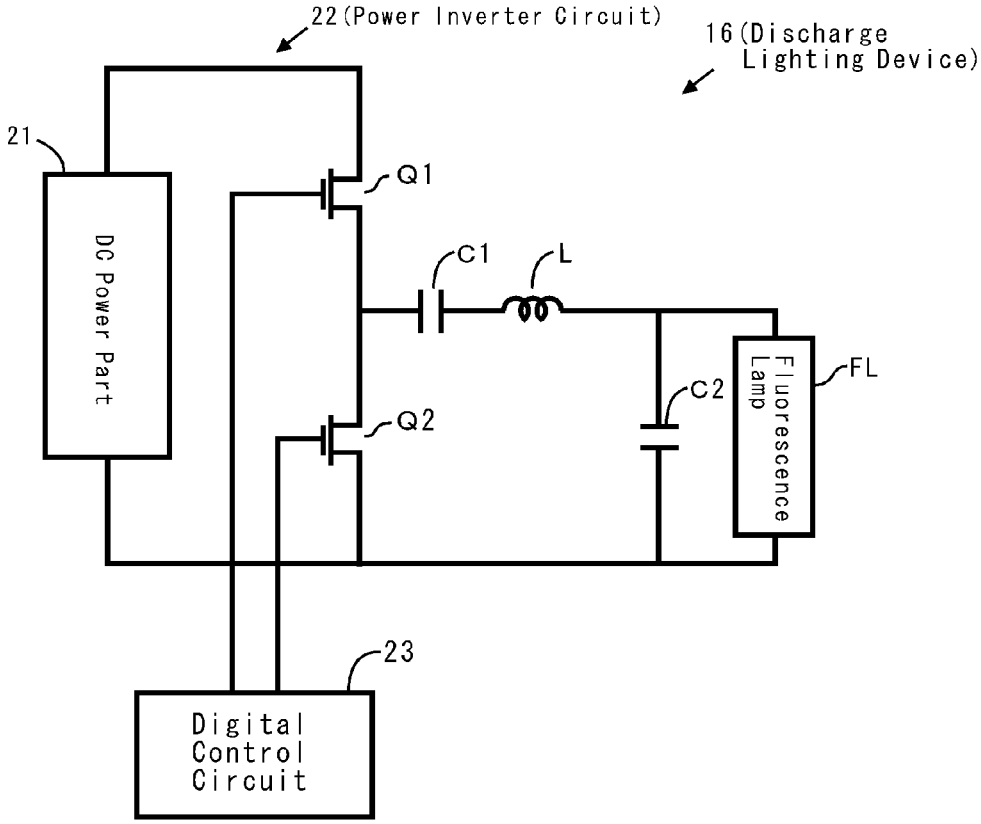
FIG. 2 illustrates a circuit diagram for a load control device in accordance with one embodiment of the invention.
Figure 3:
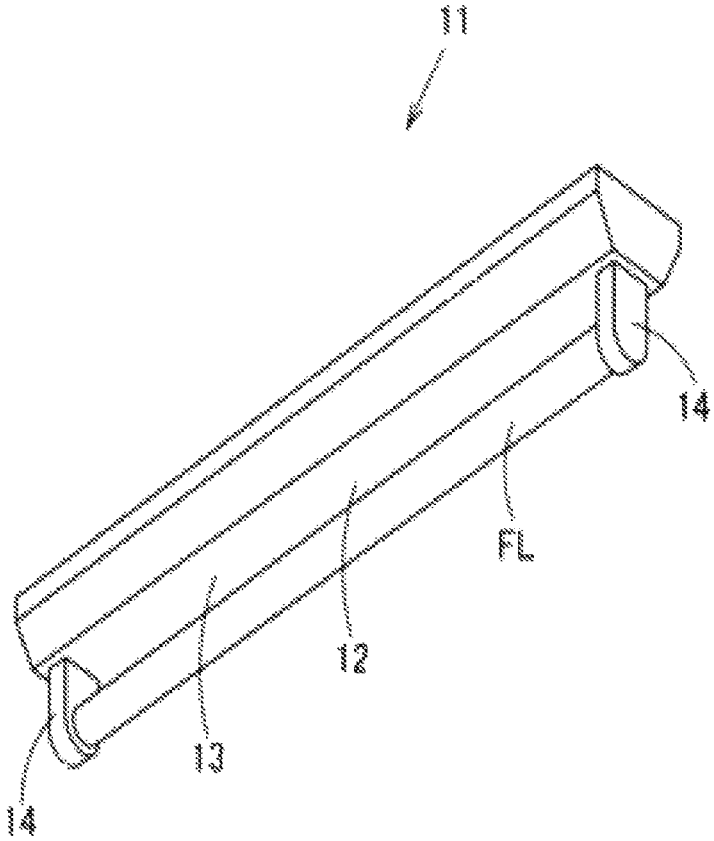
FIG. 3 illustrates a perspective view indicating a lighting device equipped with load control device in accordance with one embodiment of the invention.

FIG. 1 shows a block diagram of a load control device, FIG. 2 shows a circuit diagram for a load control device, FIG. 3 is a perspective diagram appearance of a lighting device equipped with a load control device, FIGS. 4*a*, 4*b*, 4*c*, and 4*d* are graphs indicating load of load control device and amount of electricity in each switching element. FIGS. 5*a* and 5*b* are charts for explanation indicating operation of a first conversion device in a load control device. FIGS. 6*a*, 6*b*, and 6*c* are charts for explanation showing detection algorithm for a peak value of a current at switching element/elements of load control device and a peak value of electricity at a load, and FIG. 7 is an enlarged explanation chart showing detection algorithm for peak value of current at switching element of load control device.

As shown in FIG. 3, 11 is a lighting device, and this lighting device 11 is equipped with a mechanical body 12 and below the mechanical body 12 is formed a reflection surface 13. A lamp socket 14 is equipped at both longer ends of reflection surface 13 and pipe-shaped fluorescence lamp FL, a discharging lamp as a load, is electrically or mechanically equipped between the lamp sockets 14. Within the mechanical body 12, a discharge lighting device 16 which turns on discharging lamp as a load control device as shown in FIG. 1 is mounted.

As shown in FIG. 2, a power inverter circuit 22, a circuit for turning on discharging lamp, is connected to a DC power part 21 which was rectified and leveled from commercial AC power not shown. The power inverter circuit 22 is a half bridge-shaped circuit in which field effect transistor (FET) Q1 and Q2 as a switching element is serial connected and inverter current $i_{out0}$ (FIG. 4(*b*)) is passing through.

Even more particularly, a digital control circuit 23 for a digital controller controlling part as a control circuit is connected to the gate for these field effect transistors Q1 and Q2.

A serial circuit of a capacitor C1 for DC cutting and an inductor L1 is applied to a connection point for field effect transistor (FET) Q1 and Q2 and connected to one end of fluorescence lamp FL and one side of the fluorescence lamp FL not shown is connected to a negative pole of the DC power part 21. The fluorescence lamp FL is parallel connected to a starting-up capacitor C2. The digital control circuit 23 is connected to a gate which is a digital controlling part as a controlling circuit.

Figure 4:
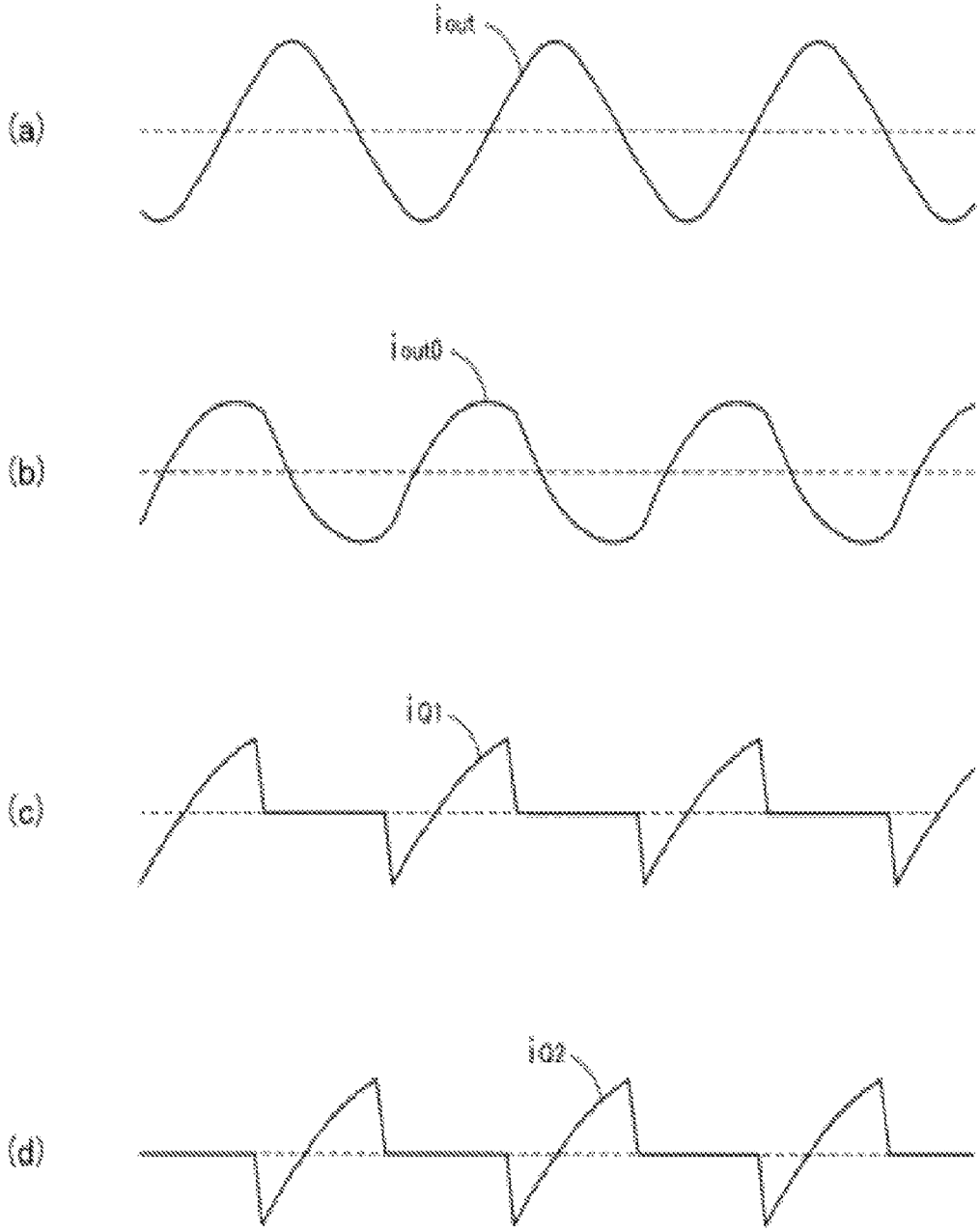
FIGS. 4*a*, 4*b*, 4*c*, and 4*d* illustrate graphs indicating load of above load control device and amount of electricity for each switching element.

And as shown in FIG. 1, the digital control circuit 23 is connected to a selection circuit 31 selecting electric current $i_{Q1}$,$i_{Q2}$ (FIG. 4(*c*) and FIG. 4(*d*)) passing through field effect transistor (FET) Q1 and Q2, and to a first conversion part 32 as the first conversion device and a zero cross detection circuit 33 and a synchronization signal generation circuit 34. And at the same time, a prediction circuit 35 (hereafter called prediction circuit 35) is connected to the first conversion part 32 when turning off with prediction device and a correction device, and the prediction circuit 35 is connected to a second conversion part 37 through a rectifying circuit 36. In addition, the prediction circuit 35 is connected to the second conversion part 37 by the rectifying circuit 36. In addition, electric current values, both of $i_{Q1}$,$i_{Q2}$ is merely called current value i.

The selection circuit 31 detects and selects parts through which current is passing among field effect transistors (FET) Q1 and Q2 and the selected current is discharged to the first conversion part 32. In addition, the selection circuit 31 can be configured in a way that it is forced to select either field effect transistor (FET) Q1 or Q2.

The first conversion part 32, for example, is connected to a current control oscillator (ICO) 4 (ICO) 41 as an A/D converter and a counter 42 as measuring device one by one.

Figure 5:
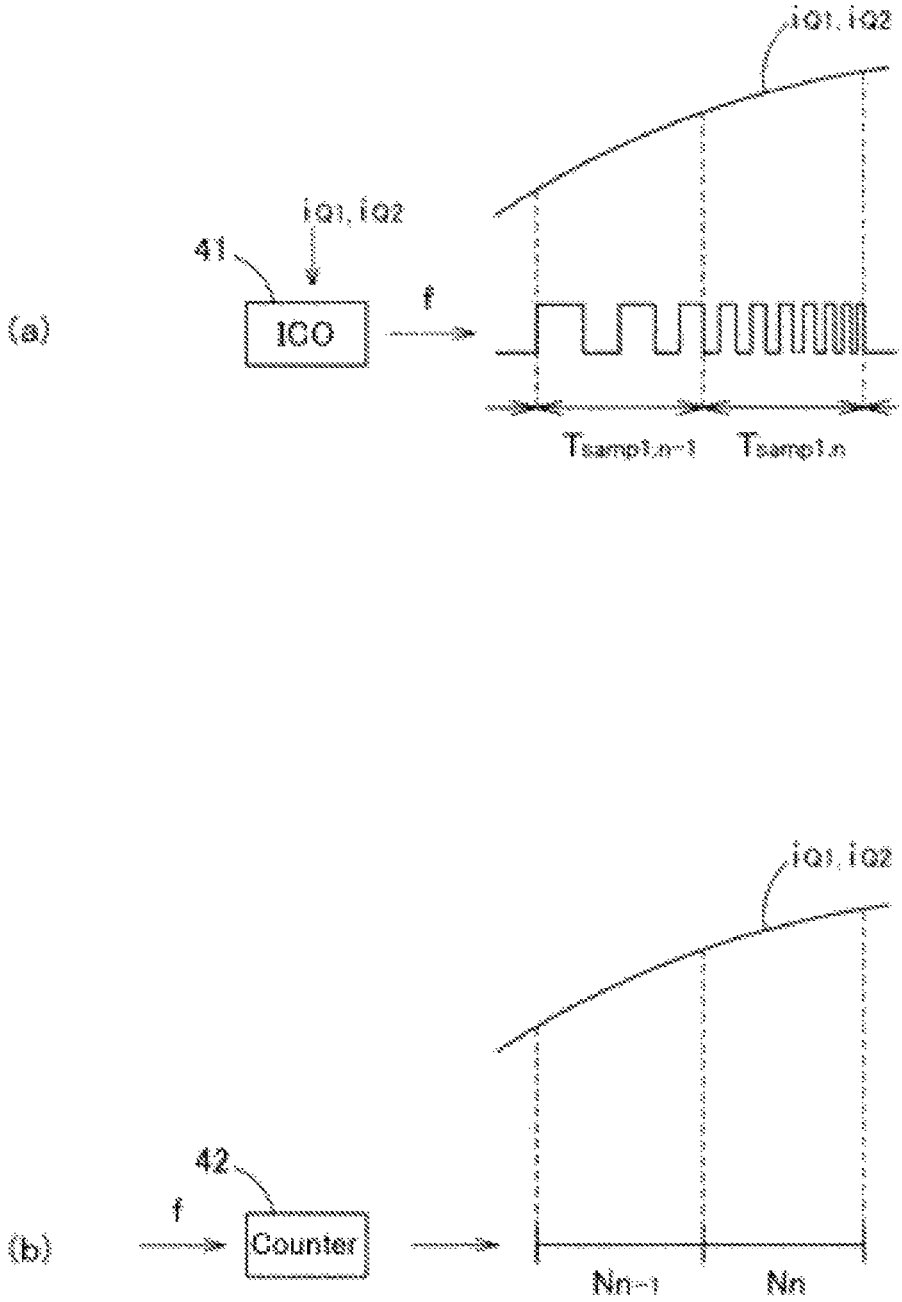
FIGS. 5*a* and 5*b* illustrate charts for explanation indicating operation of a first conversion method in above load control device.

The current control oscillator 41, when current i selected by the selection circuit 31 is input, performs sampling for certain sampling frequency (FIG. 5(*a*) and FIG. 5(*b*)) which is sampling frequency of the first conversion part 32, i.e. by 50 MHz frequency and outputs clock signal f corresponding to current value i as a digital amount.

For example, the current control oscillator 41 outputs high frequency clock signal f when current is high. In addition, a voltage control oscillator which generates clock signal f by sampling voltage converted by a conversion device from current to voltage on behalf of the current control oscillator 41 by converting current i into its voltage can be used.

The counter 42 is for counting clock signal f generated by current control oscillator 41 within certain period. Number of counts measured by the counter 42, for example if switching cycle for field effect transistors Q1 and Q2 are 10 μs (switching frequency 100 kHz) and sampling frequency for current control oscillator 41 is 50 MHz and if time span $T_{sample}$ which is sampling cycle for synchronization signal generation circuit 34 is 0.1 μs (sampling frequency is 10 MHz), is possible to take about 5, and about 10 if time span $T_{sample}$, for example is 0.2 μs (sampling frequency is 5 MHz), and about 50 when time span $T_{sample}$ is 1.0 μs (sampling frequency is 1 MHz). And counter 42 outputs count number Nn into prediction circuit 35 which is average value for each time span $T_{sample}$ by n intervals.

The zero cross detection circuit 33 detects zero cross point for current i (point changed correctly at edge) and outputs this detected timing to the signal generating circuit 34 during same period, and this output resets the counter 42 for the current control oscillator 41 and starting timing by same period of signal for each time span $T_{sample}$ generated by the signal generation circuit 34 of same period, and it makes it possible to equalize sampling frequency of the conversion part 32 at cross point of current i.

In other word, sampling frequency of the first conversion part 32 is synchronized in switching frequency of the power inverter circuit 22 (FIG. 2). In addition, sampling frequency of the first conversion part 32 doesn't necessarily need to be synchronized in switching frequency of the inverter circuit 22 (FIG. 2). In this case, zero cross detection circuit 33 doesn't necessarily need to be made.

Figure 6:
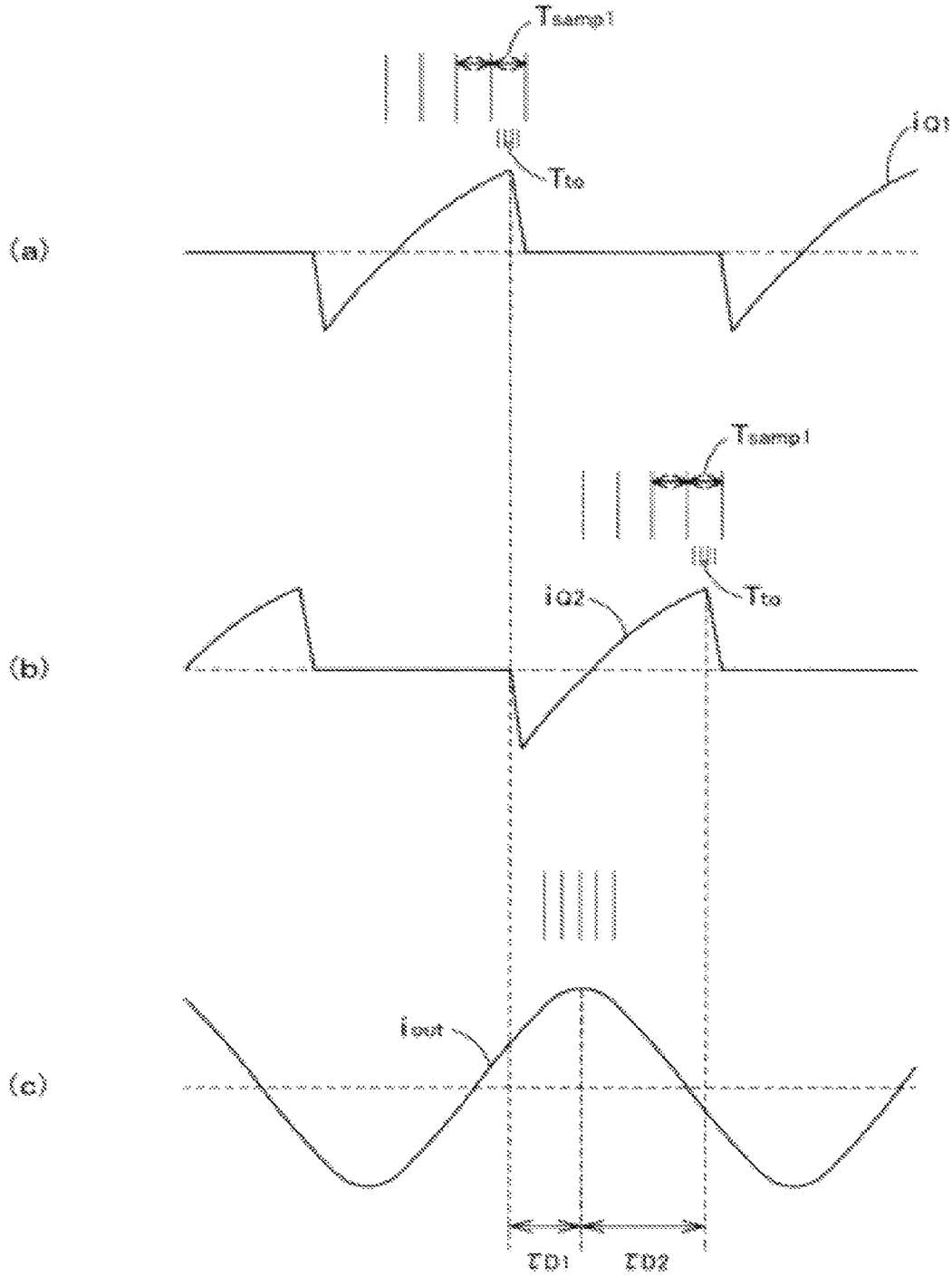
FIGS. 6*a*, 6*b*, and 6*c* illustrate charts for explanation indicating detection algorithm for peak value of current in switching element of above load control device and peak value for electricity in load.
Figure 7:
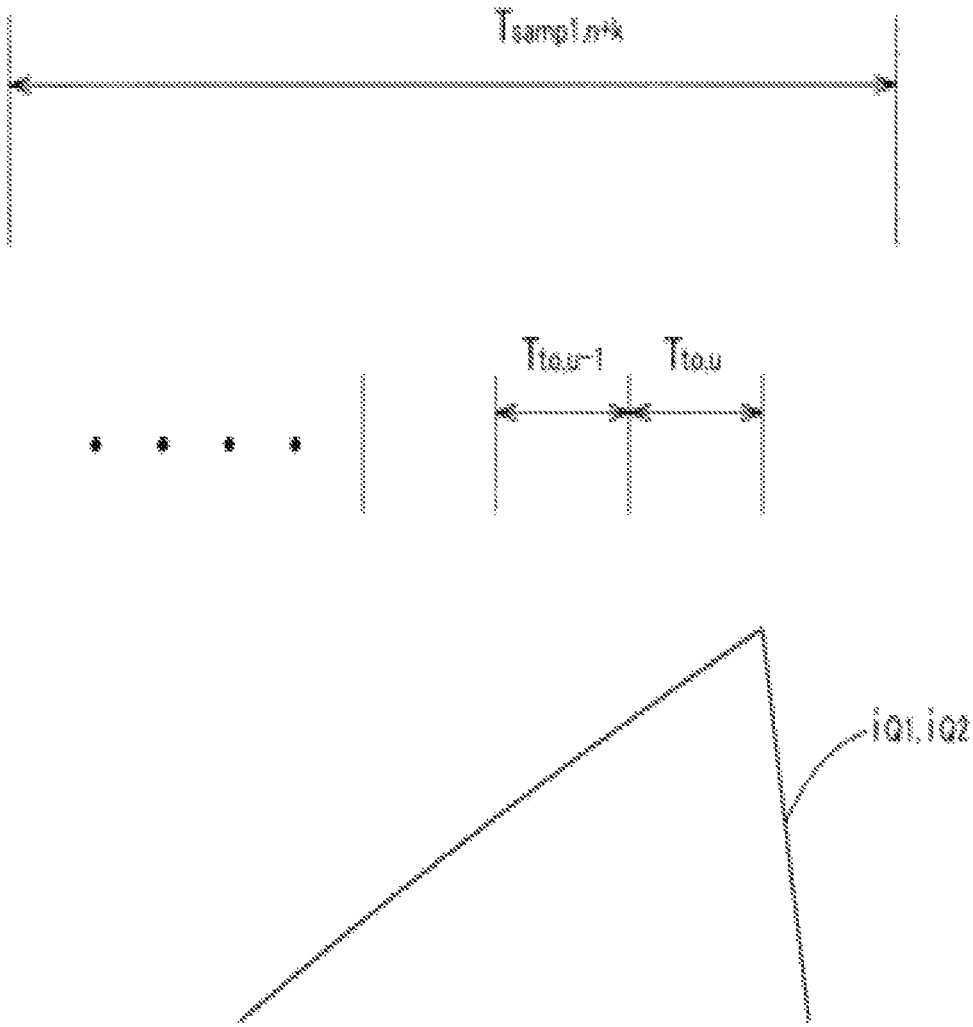
FIG. 7 illustrates a chart for explanation enlarging some of detection algorithm for peak value of current in switching element of above load control device.

The prediction circuit 35 becomes less than minimum physical amount $N_{DREF}$ to extent which difference $N_D=N_n-N_n-1$ between counter number Nn converted at certain timing by the first conversion part 32 and next timing counter Nn reacts, and based on rate of variations in difference $N_D$ i.e. $N_{DD,n}=N_{D,n}-N_{D,n-1}$, $N_{DD,n-1}=N_{D,n-1}-N_{D,n-2}$, . . . , $N_{DD,n-v}=N_{D,n-v}-ND,_{n-v-1}$, it is possible to predict the timing when one of current values $i_{Q1}$ and $i_{Q2}$ from field effect transistors Q1 and Q2 (FIG. 6(*a*) and FIG. 6(*b*)). In addition, this prediction circuit 35 depends on absolute digital amount to each time span $T_{sample}$,k(k=1, 2, . . . , n−1, n, . . . ) i.e. plural number of each count number $N_k$(k=1, 2, . . . , n−1, n, . . . ) and it makes it possible to predict the timing when one of current value $i_{Q1}$ or $i_{Q2}$ is a peak.

The rectifying circuit 36 rectifies electricity of fluorescence lamp FL by wave rectification, i.e. AC lamp current $i_{out}$ which is output current and outputs the rectified one into the second conversion part 37. In addition, output current or electric power, for example, is good as electricity of fluorescence lamp FL.

The second conversion part 37 equipped with plural number of $2^{nd}$ converting method, A/D converter 37 a inside converts fluorescence lamp current $i_{out}$ generated from rectifying circuit 36 into digital amount by A/D converting by controlling A/D converter 37 a. i.e. by slackening each phase to a certain level (FIG. 6 (*c*)). Therefore, the second conversion part 37 carries out sampling by higher sampling frequency than that of A/D converter 37 a. i.e. with lower time span $T_{samp2}$ than sampling time span of A/D converter 37 a. In addition, second conversion part 37 receives sampling timing from the prediction circuit 35.

In addition, the second conversion 37, if it is possible to compare with standard analogue amount, and to correct temperature, can substitute each A/D converter 37*a* and can be configured in a way that a pair of voltage control oscillator and counter is composed, or only the A/D converter 37*a* can be used.

And a switch selection circuit 38 is connected to each gate for field effect transistors Q1 and Q2 and controls switching at the time which is predicted by the prediction circuit 35. The switch selection circuit 38 usually controls field effect transistors Q1 and Q2 by about 100 kHz of switching frequency (10μs of switching cycle)

Following is a example for one cycle of operation mentioned above.

Field effect transistors Q1 and Q2 is switch controlled by the digital control circuit 23, and high frequency voltage discharged from the power inverter circuit 22 is converted to resonance voltage of the DC cutting capacitor C1, the inductor L and the starting capacitor C2 and this resonance voltage pre-heats filament of the fluorescence lamp FL and turn on the fluorescence lamp FL.

Here in this digital circuit 23 detects, the zero cross detection circuit 33 detects the timing current value of $i_{Q1}$ is actual, and this zero cross detection signal is input to the selection circuit 31 and the selection circuit 31 selects current value, $i_{Q1}$, and the selected current value $i_{Q1}$ is converted to clock signal f corresponding to absolute amount of current by the current control oscillator 41, and the converted clock signal f is counted by the counter 42.

In this case, zero cross detection signal from the zero cross detection circuit 33 is input to the synchronization signal generation circuit 34, and operation timing with the counter 42 is reset to the current control oscillator 41, and sampling cycle of the current control oscillator 41 (the first conversion part 32) is synchronized with switching cycle of the power inverter circuit 22.

And next, if counting number Nn for each time span $T_{sample}$,n(n=1, 2, . . . ) is input to the prediction circuit 35 by the counter 42, the prediction circuit 35 calculates differences $N_D$, n based on counting number $N_n$. And it predicts when differences $N_{D,\ n}$ is less than minimum physical amount $N_{DREF}$ which has generated certain reaction, i.e. when $N_{D,n} \leqq N_{DREF}$, predicts 'turn-off' timing $T_{to,u}$ for Field effect transistor Q1.

More specifically, prediction circuit 35 calculates differences $N_{DD}$, i.e. $N_{DD,n}=N_{D,n}-N_{D,n-1}$, $N_{DD,n}=N_{D,n-1}-N_{D,n-2}$, . . . , $N_{DD,n-v-1}=N_{D,n-v}-N_{D,n-v-1}$, and based on this variation, it generates higher clock frequency than sampling frequency of the first conversion part 32, and predicts peak timing of current value $i_{Q1}$ located at time span $T_{sample}$ after sampling cycle for k number, i.e. $T_{to}$ which is shorter time span than time span $T_{sample}$ (FIG. 7)

Here, if variation of differences $N_{DD}$ is getting lowered, assuming that it is more and more approaching to a peak value, and if the difference $N_{DD}$ is less than certain value, it assumes that the value is peak value.

Note that k is usually set to 1 or 2. For example, in the event setting resolution of threshold value N is short, big value is set as k. Lack of this setting resolution is supplemented by doing it this way.

For example, including case that above mentioned timing $T_{to,u}$ is predicted within part which is not varied for slope of current passing through field effect transistor Q1 and if it is impossible to predict timing, $T_{to,u}$ as switching frequency of field effect transistor Q1 and Q2 I is varied to a large extent, the prediction circuit 35, based on absolute amount of pair of counting number $N_n$, predicts the timing when current value $i_{Q1}$ is peak. In addition, targeted peak value for current value i is set by difference between lamp current $i_{out}$ and its targeted value.

And based on timing $T_{to,u}$ which is predicted by the estimator circuit 35, this estimator circuit 35 controls the switch selection circuit 38 with slightly small PWM signal of time width $T_{to}$. This switch selection circuit 38 makes the field effect transistor (Q1 in the present embodiment) that current value i was selected by selection circuit 31 turn off in timing T which it predicted in estimator circuit 35. At timing T1 or timing T2, field effect transistor Q2 turns on.

In the mean time, lamp current $i_{out}$ is rectified by the rectifying circuit 36 and each A/converter 37 a of the second conversion part 37 is controlled by multi-rate, and it is converted to digital amount corresponding to certain time span $T_{samp2}$ after time, $\tau_{D1}$ from timing $T_{to,u}$.

And the prediction circuit 35 detects peak value for lamp current, $i_{out}$ by converted digital amount, and based on this detection, it suitably corrects minimum reacting physical amount, $N_{DREF}$.

In this case, digital amount of the second conversion part 37 which is used to correct minimum physical reacting amount, $N_{DREF}$, for example, it uses average of digital amount converted by each A/D converter, 37*a* if time span $T_{samp2}$ is relatively short, and it uses maximum or minimum value of digital amount converted by each A/D converter, 37*a* if time span, $T_{samp2}$ is relatively long.

As the result, this corrected timing. i.e. by the time delayed from detection timing for peak value of lamp current iout to time, $\tau_{D2}$, the field effect transistor Q2 is turned off same as 'turn off control' of the field effect transistor Q1 mentioned above, and then the field effect transistor Q1 is turned ON. In other words, 'turn-off timing (PWM signal output) after half cycle of switching cycle for the field effect transistor Q1 and Q2.

After that, control for the field effect transistor Q1 and Q2 are repeated alternatively by same procedure mentioned above.

As mentioned above, on condition that difference between the counting number, $N_{n-1}$ converted by the first conversion part 32 and the next counting number $N_n$ becomes less than minimum physical amount, $N_{DREF}$ which generates certain level of reaction, and based on this difference, $N_D$, it predicts the timing, $T_{to,u}$ when current values, $i_{Q1}$,$i_{Q2}$ passing through the field effect transistor Q1,Q2 reached at peak, and at this predicted 'turn-off' timing $T_{to,u}$, the switch selection circuit 38 turns off the field effect transistor which was ON, i.e. the field effect transistor Q1, and at the same time, it turns on the field effect transistor Q1 which was ON.

In the mean time, by controlling plural number of a A/D converter 37 a with multi-rate near by 'turn-off' timing, $T_{to,u}$ predicted by the prediction circuit 35, and it converts lamp current $i_{out}$ into digital amount, and by this digital amount, it detects peak value of lamp current $i_{out}$, and based on this detection, it corrects the prediction of timing for the prediction circuit 35, and more specifically correcting minimum physical amount, $N_{DREF}$ which generated reactions. This algorithm is able to set 'turn-off' timing, $T_{to,u}$ exactly without having to enlarge sampling frequency for the first conversion part 32 although peak value, i exists between sample cycle for the first conversion part 32. Therefore, it enhances practical use and controls the fluorescence lamp FL for ON and OFF.

In addition, based on absolute amount of counting number, $N_n$ converted by the first conversion part 32, the prediction circuit 35 predicts the timing when current value, i reached at its peak value, and at this predicted timing, switch selection circuit 38 turns off field effect transistor which was "ON state", here, field effect transistor Q1 and at the same time, it turns on field effect transistor which was "OFF state", here, field effect transistor Q2. As it is possible to turn off field effect transistor, here referred to field effect transistor Q1 along with varying rate for difference, $N_D$ for counting number, $N_n$ by corresponding to peak value i of current even based on absolute amount of current i. Therefore it is able to control load more correctly.

Moreover, by predicting the timing, $T_{to,u}$ when current, i reaches at peak value based on calculated result for difference, $N_D$ of counting number Nn before several cycles of time span $T_{sample}$ which is peak, it is able to acquire calculation time.

And as current values of field effect transistors Q1,Q2 near by input for device of turning discharge lamp on sets 'turn-off' timing, its response is good. Especially as fluorescence lamp FL is vulnerable to be turned off or blinking if response is slow at the lighting device 11, it is able to prevent this turning off or blinking by enhancing response ability.

In addition, in usual case, when rate fir difference, $N_D$ is increasing for the reducing prediction circuit 35, the switch selection circuit 38 turns off field effect transistor Q1 or Q2, therefore it prevents over current due to malfunction of circuits from field effect transistor Q1 or Q2

In addition, in case of one cycle for above procedure, it's also possible to control lamp current $i_{out}$ every single cycle by controlling only one of field effect transistor Q1 or Q2. In this case, it's easier and desirable to control field effect transistor Q2.

In addition, for setting 'turn-off' timing mentioned above, it's recommended that its 'turn-off' timing is carried out for each cycle during transition time for the lighting device 11 of discharge lamp, and for several cycle during stabilized period.

Moreover, the first conversion part 32 has same functions as the current control oscillator 41 and the counter 42. For example, it's possible to use 8 bit flash-typed A/D converter. In this case, for example, it is possible to use either A/D converter 37*a* of the second conversion part 37, or 37*a* of A/D converter of the second conversion part 3.

And in electrical amount in load, for example, output current or power besides output current such as lamp current $i_{out}$ are possible to be controlled as procedure mentioned above.

In addition, correction device substitute correction of minimum physical amount, $N_{DREF}$ which generates reaction, and it's also possible to control by varying k value of time span, Tsamp1, n+k or use both of them simultaneously.

And for controlling fluorescence lamp FL, above the load control device can be used.

What is claimed is:

1. A load control device comprising:

an inverter circuit equipped with switching elements for driving a load;

a first conversion device which converts analogue current value passing through the on-state switching element into digital amount corresponding to a current sampling frequency;

a predicting device which predicts timing that a value of current passing through the switching element reaches a peak, under a difference between the digital amount converted according to a prescribed timing by the first conversion device and a digital amount of a timing is below a prescribed threshold;

a switch selection circuit which turns off the switching elements at the predicted timing by the prediction device driven with a frequency higher than the sampling frequency for the first conversion device, and turns on the switching element which was under off-state;

a second conversion device which converts an amount of electricity from the load into a digital amount; and a correction device which detects a peak value of electricity coming from the load by a digital amount converted by the second conversion device and based on this detected peak value, corrects prediction of timing.

2. The load control device of claim 1, wherein said prediction device predicts the timing when a current value passing through the switching elements reaches its peak, based on an absolute amount of digital converted by the first conversion device, said switch selection circuit turns off the switching element under on-state at the predicted timing, and turns on the switching element under off-state.

3. A lighting device comprising:

the load control device of claim 2; and a mechanical body which is equipped with the load, which is a discharge lamp which is turned on by the load control device.

4. The load control device of claim 1, wherein said switch selection circuit turns off the switching element when said predicting device senses an increase of the difference of the digital amounts.

5. A lighting device comprising:

the load control device of claim 4; and a mechanical body which is equipped with the load, which is a discharge lamp which is turned on by the load control device.

6. A lighting device comprising:

the load control device of claim 1; and a mechanical body which is equipped with a load, which is a discharge lamp which is turned on by the load control device.

* * * * *